US008403465B2

(12) United States Patent
Von Essen et al.

(10) Patent No.: US 8,403,465 B2
(45) Date of Patent: Mar. 26, 2013

(54) APPARATUS FOR REDUCING CROSSTALK IN THE SUPPLY AND RETURN CHANNELS DURING FLUID DROPLET EJECTING

(75) Inventors: Kevin Von Essen, San Jose, CA (US); Mats G. Ottosson, Cupertino, CA (US); Paul A. Hoisington, Hanover, NH (US); Christoph Menzel, New London, NH (US)

(73) Assignee: FUJIFILM Corporation, Tokyo (JP)

( * ) Notice: Subject to any disclaimer, the term of this patent is extended or adjusted under 35 U.S.C. 154(b) by 492 days.

(21) Appl. No.: 12/712,614

(22) Filed: Feb. 25, 2010

(65) Prior Publication Data

US 2010/0214380 A1 Aug. 26, 2010

Related U.S. Application Data

(60) Provisional application No. 61/155,875, filed on Feb. 26, 2009.

(51) Int. Cl.
*B41J 2/175* (2006.01)

(52) U.S. Cl. ..... 347/85

(58) Field of Classification Search ..... 347/84–86, 347/92, 68–72

See application file for complete search history.

(56) References Cited

U.S. PATENT DOCUMENTS

| | | | | |
|---|---|---|---|---|
| 4,835,554 | A | 5/1989 | Hoisington et al. | |
| 5,771,052 | A | 6/1998 | Hine et al. | |
| 6,074,035 | A | 6/2000 | Irizawa et al. | |
| 6,857,722 | B1 | 2/2005 | Greiser et al. | |
| 6,886,924 | B2 | 5/2005 | Hasenbein et al. | |
| 7,128,406 | B2 | 10/2006 | Dixon et al. | |
| 7,309,119 | B2 | 12/2007 | Kojima | |
| 2002/0051039 | A1 | 5/2002 | Moynihan et al. | |
| 2005/0052506 | A1 * | 3/2005 | Yagi et al. | 347/72 |
| 2007/0046736 | A1 | 3/2007 | Katayama et al. | |
| 2008/0030553 | A1 | 2/2008 | Takahashi | |
| 2008/0055378 | A1 | 3/2008 | Drury et al. | |
| 2010/0141713 | A1 * | 6/2010 | Hoisington et al. | 347/68 |

FOREIGN PATENT DOCUMENTS

| | | |
|---|---|---|
| JP | 2002210965 | 7/2002 |
| JP | 200626953 | 9/2007 |
| WO | 2009/143362 A8 | 11/2009 |

OTHER PUBLICATIONS

International Search Report and Written Opinion dated Jul. 23, 2009 issued in international application No. PCT/US2009/044868, 10 pgs.

Laurell et al., "Design and development of a silicon microfabricated flow-through dispenser for on-line picolitre sample handling," J.Micromech.MICROENG. 9:369-76 (1999).

International Preliminary Report on Patentability dated Dec. 2, 2010 issued in international application No. PCT/US2009/044868, 9 pgs.

* cited by examiner

*Primary Examiner* — Kristal Feggins
(74) *Attorney, Agent, or Firm* — Fish & Richardson P.C.

(57) ABSTRACT

A fluid droplet ejection apparatus includes a substrate having a fluid inlet passage, a plurality of nozzles, and a plurality of flow paths each fluidically connecting the fluid inlet passage to an associated nozzle of the plurality of nozzles. Each flow path includes a pumping chamber connected to the associated nozzle and an ascender fluidically connected between the fluid inlet passage and the pumping chamber. The ascender is located proximate to an outside edge of the fluid inlet passage.

29 Claims, 7 Drawing Sheets

APPARATUS FOR REDUCING CROSSTALK IN THE SUPPLY AND RETURN CHANNELS DURING FLUID DROPLET EJECTING

CROSS-REFERENCE TO RELATED APPLICATIONS

This application claims priority to U.S. Provisional Application Ser. No. 61/155,875, filed on Feb. 26, 2009, which is incorporated by reference.

BACKGROUND

This invention relates generally to fluid ejection devices. In some fluid ejection devices, fluid droplets are ejected from one or more nozzles onto a medium. The nozzles are fluidically connected to a fluid path that includes a fluid pumping chamber. The fluid pumping chamber can be actuated by an actuator, which causes ejection of a fluid droplet. The medium can be moved relative to the fluid ejection device. The ejection of a fluid droplet from a particular nozzle is timed with the movement of the medium to place a fluid droplet at a desired location on the medium. In these fluid ejection devices, it is usually desirable to eject fluid droplets of uniform size and speed and in the same direction in order to provide uniform deposition of fluid droplets on the medium.

SUMMARY

In general, in one aspect, a fluid droplet ejection apparatus includes a substrate having a fluid inlet passage, a plurality of nozzles, and a plurality of flow paths each fluidically connecting the fluid inlet passage to an associated nozzle of the plurality of nozzles. Each flow path includes a pumping chamber connected to the associated nozzle and an ascender fluidically connected between the fluid inlet passage and the pumping chamber. The ascender is located proximate to an outside edge of the fluid inlet passage.

This and other embodiments can optionally include one or more of the following features. The pumping chamber inlet can extend horizontally from the ascender to the pumping chamber.

In general, in one aspect, a fluid droplet ejection apparatus includes a substrate including a fluid inlet passage having a first side and a second side, a first plurality of nozzles, a second plurality of nozzles, a first plurality of flow paths each fluidically connecting the fluid inlet passage to an associated nozzle of the first plurality of nozzles, and a second plurality of flow paths each fluidically connecting the fluid inlet passage to an associated nozzle of the second plurality of nozzles. Each flow path of the first and second pluralities of flow paths includes a pumping chamber connected to the associated nozzle and a pumping chamber inlet passage fluidically connecting the fluid inlet passage and the pumping chamber. Each pumping chamber of the first plurality of flow paths is located closer to the first side of the fluid inlet passage than the second side, and each pumping chamber of the second plurality of flow paths is located closer to the second side of the fluid inlet passage than the first side. Each pumping chamber inlet passage of the first plurality of flow paths is connected to the fluid inlet passage closer to the second side of the fluid inlet passage than the first side, and each pumping chamber inlet passage of the second plurality of flow paths is connected to the fluid inlet passage closer to the first side of the fluid inlet passage than the second side.

This and other embodiments can optionally include one or more of the following features. Each pumping chamber inlet passage can include a pumping chamber inlet fluidically connected between the pumping chamber and an ascender, the ascender being fluidically connected to the fluid inlet passage. A pumping chamber inlet of the first plurality of flow paths can extend past an edge of a pumping chamber of the second plurality of flow paths, and a pumping chamber inlet of the second plurality of flow paths can extend past an edge of a pumping chamber of the first plurality of flow paths.

A pumping chamber of the first plurality of flow paths can include an exterior edge proximate to the first side of the fluid inlet passage and an interior edge near a center of the fluid inlet passage, and a pumping chamber of the second plurality of flow paths can comprise an exterior edge proximate to the second side of the fluid inlet passage and an interior edge near a center of the fluid inlet passage. An ascender of the second plurality of flow paths can be closer to the exterior edge of a pumping chamber in the first plurality of flow paths than the interior edge of the pumping chamber in the first plurality of flow paths, and an ascender of the first plurality of flow paths can be closer to the exterior edge of a pumping chamber in the second plurality of flow paths than the interior edge of the pumping chamber in the second plurality of flow paths. An ascender of the second plurality of flow paths can be horizontally aligned with the exterior edge of a pumping chamber in the first plurality of flow paths, and an ascender of the first plurality of flow paths can be horizontally aligned with the exterior edge of a pumping chamber in the second plurality of flow paths.

The pumping chamber can be connected to the associated nozzle through a descender fluidically connected to the pumping chamber and the associated nozzle. An ascender of the first plurality of flow paths can be closer to a descender of the second plurality of flow paths than to another ascender, and an ascender of the second plurality of flow paths can be closer to a descender of the first plurality of flow paths than to another ascender.

The ascender can extend vertically from the fluid inlet passage to the pumping chamber inlet. The pumping chamber inlet can be perpendicular to the ascender. The pumping chamber inlet can run horizontally from the pumping chamber to the ascender. The pumping chamber inlets of the respective flow paths can run parallel to each other.

The fluid droplet ejection apparatus can further include an actuator in pressure communication with the substrate. There can be a plurality of fluid inlet passages, and the fluid inlet passages can run parallel to each other. The nozzles can be arranged in a line. The pumping chambers of the first plurality of flow paths can be arranged in a first line, the pumping chambers of the second plurality of flow paths can be arranged in a second line, and the first and second line can be parallel.

In general, in one aspect, a fluid droplet ejection apparatus includes a substrate including a plurality of flow paths, each flow path including a fluid pumping chamber and an ascender fluidically connected to the fluid pumping chamber. The fluid droplet ejection apparatus can further include a fluid inlet passage fluidically connected to the pliurality of flow paths. The fluid inlet passage can include a channel having side walls, and a plurality of protrusions can extend from the sidewalls.

This and other embodiments can optionally include one or more of the following features. Ascenders of the plurality of flow paths can extend vertically through the protrusions. The plurality of protrusions can extend the entire height of the fluid inlet passage. The plurality of protrusions can extend laterally outward. Each of the plurality of protrusions can extend in between a pair of descenders, and each of the descenders can be part of a corresponding flow path in the plurality of flow paths, and each of the descenders can be in fluid connection with the corresponding pumping chamber. Each of the plurality of protrusions can have approximately the same length. The fluid droplet ejection apparatus can further include a pumping chamber inlet fluidically connected to the pumping chamber and the ascender, and the pumping chamber inlets in the plurality of flow paths can extend horizontally into the protrusions.

Certain implementations may have one or more of the following advantages. Crosstalk in the supply and return channels during fluid droplet ejection can be reduced. Where a pumping chamber inlet passage of the first plurality of flow paths is connected to the fluid inlet passage closer to the second side of the fluid passage than the first, impedance in the inlet can be increased to prevent pressure waves in the pumping chamber from propagating into the fluid inlet passages. Where ascenders in the first plurality of flow paths are closer to the descenders of the second plurality of flow paths than to each other, the interaction of pressure waves from each flow path can be mitigated. Moreover, where an ascender extends through each respective protrusion in the plurality of protrusions, some of the energy from pressure waves can be dissipated into the walls of the fluid inlet passage rather than into the fluid inlet passage itself.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

During fluid droplet ejection, when actuators located above pumping chambers are activated, a pressure wave propagates through the pumping chamber into the ascender. Some of the energy from the pressure wave can propagate through the ascender and into the fluid inlet passage. Likewise, some of the energy can propagate through the descender to the recirculation passage. This propagation can cause pressure waves in the fluid inlet passages and recirculation passages and cross-talk between neighboring flow paths, which can adversely affect fluid droplet ejection performance. The fluid ejection performance can be controlled by altering the configuration of the printhead, such as the configuration of the ascenders, descenders, and pumping chambers. For example, without being limited to any particular theory, protrusions on the side walls of the fluid inlet passage can dissipate pressure waves. As another example, lengthening the passage between the ascender and pumping chamber increases fluid impedance to reduce propagation of pressure waves from the pumping chamber into the fluid inlet passages.

Fluid droplet ejection can be implemented with a substrate including a flow path body, a membrane, and a nozzle layer. The flow path body has a flow path formed therein, which can include a fluid pumping chamber, a descender, and an ascender. The flow path can be microfabricated. An actuator can be located on a surface of the membrane opposite the flow path body and proximate to the fluid pumping chamber. When the actuator is actuated, the actuator imparts a firing pulse to the fluid pumping chamber to cause ejection of a droplet of fluid through the outlet. A recirculation passage can be fluidically connected to the descender in close proximity to the nozzle and the outlet, such as flush with the nozzle. Fluid can be constantly circulated through the flow path and fluid that is not ejected out of the outlet can be directed through the recirculation passage. Frequently, the flow path body includes multiple flow paths and nozzles.

A fluid droplet ejection system can include the substrate described. The system can also include a source of fluid for the substrate as well as a return for fluid that is flowed through the substrate but is not ejected out of the nozzles of the substrate. A fluid reservoir can be fluidically connected to the substrate for supplying fluid, such as ink, to the substrate for ejection. Fluid flowing from the substrate can be directed to a fluid return tank. The fluid can be, for example, a chemical compound, a biological substance, or ink.

Figure 1A:
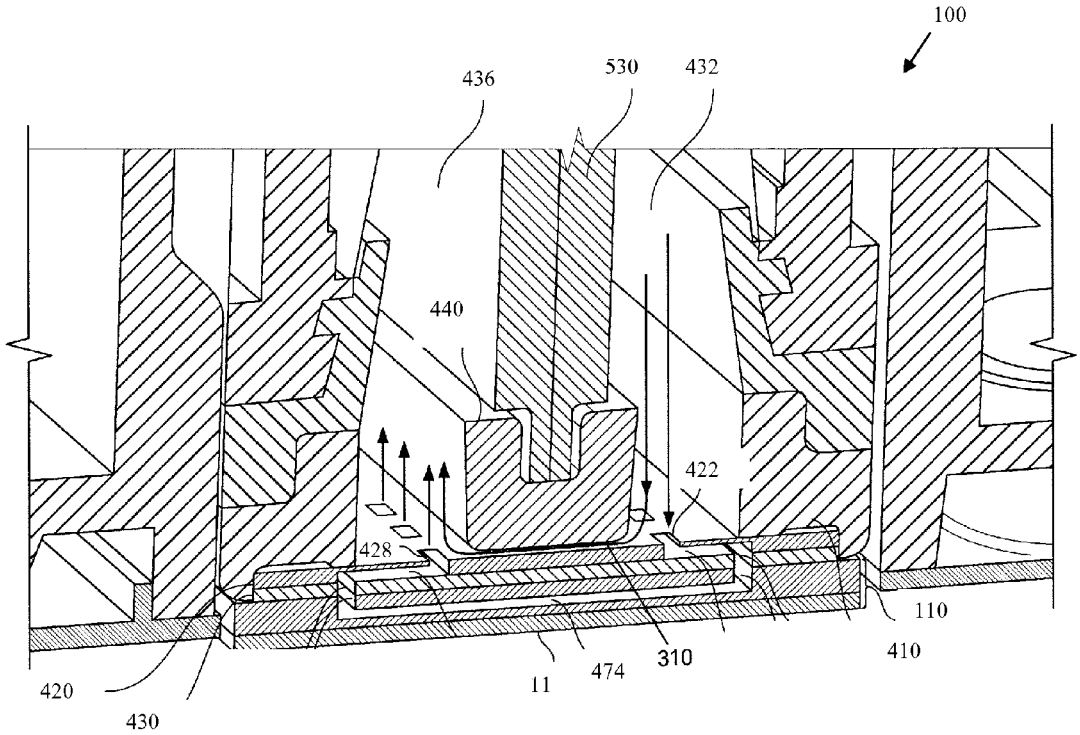
FIG. 1A is a cross-sectional view of a printhead.

Referring to FIG. 1A, printhead 100 for ejecting droplets of fluid includes an upper divider 530 and a lower divider 440 to divide the printhead into a supply chamber 432 and a return chamber 436. A bottom of the fluid supply chamber 432 and the fluid return chamber 436 is defined by an upper interposer 420. The upper interposer 420 includes an upper interposer fluid supply inlet 422 and an upper interposer fluid return outlet 428, which can be formed as apertures in portions of an upper surface of the upper interposer 420 exposed to the fluid supply chamber 432 and the fluid return chamber 436, respectively. The upper interposer 420 can be attached to a lower printhead casing 410, such as by bonding, friction, or some other suitable mechanism. A lower interposer 430 is positioned between the upper interposer 420 and a substrate 110. The substrate 110 has a substrate flow path 474, which is shown simplified as a single straight passage for illustrative purposes. Although only one flow path 474 is shown in FIG. 1A, substrate 110 can include multiple substrate flow paths 474.

Figure 1B:
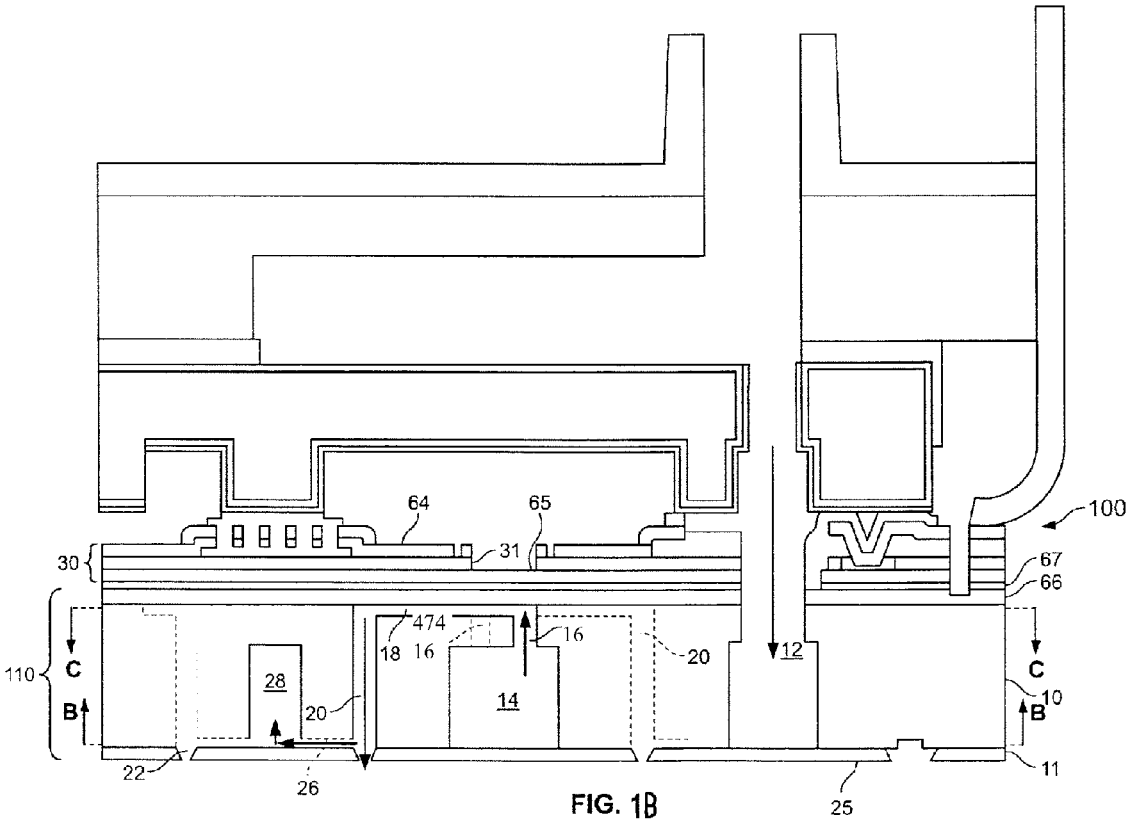
FIG. 1B is a cross-sectional side view of a portion of a printhead.

Referring to FIG. 1B, substrate 110 includes a fluid path body 10 having a plurality of flow paths 474 (only one is illustrated in the cross-sectional view of FIG. 1B), a nozzle layer 11, and a membrane 66. A substrate inlet 12 supplies a fluid inlet passage 14 with fluid.

The nozzle layer 11 is secured to a bottom surface of the flow path body 10. Multiple nozzles 22 are formed through the nozzle layer 11. Although not shown, the nozzles 22 can be arranged in parallel lines, e.g., in multiple columns of nozzles, along the nozzle layer 11. Each nozzle 22 is fluidically connected to a nearby fluid inlet passage 14 by an associated flow path 474. Each flow path 474 includes a pumping chamber 18, a descender 20, and a pumping chamber inlet passage 17 (see FIG. 2). The pumping chamber inlet passage 17 can include a pumping chamber inlet 15 and an ascender 16, as described further below, that fluidically connect the pumping chamber 18 to the fluid inlet passage 14.

The fluid pumping chamber 18 is fluidically connected to the descender 20, which is fluidically connected to the nozzle 22. A recirculation passage 26 is fluidically connected to the descender 20 at a location near the nozzle 22. The recirculation passage 26 is also fluidically connected to a recirculation channel 28, so that the recirculation passage 26 extends between the descender 20 and the recirculation channel 28. In some implementations, the ascender 16, fluid pumping chamber 18, descender 20, recirculation passage 26, and other features in the substrate can be microfabricated.

Each fluid pumping chamber 18 is in close proximity to an actuator 30. The actuator 30 can include a piezoelectric layer 31, such as a layer of lead zirconium titanate (PZT), an electrical trace 64, and a ground electrode 65. An electrical voltage can be applied between the electrical trace 64 and the ground electrode 65 of the actuator 30 to apply a voltage to the actuator 30 and thereby actuate the actuator 30. A membrane 66 is between the actuator 30 and the fluid pumping chamber 18. An adhesive layer 67 secures the actuator 30 to the membrane 66. Although the actuator 30 is shown as continuous in FIG. 1B, the piezoelectric layer 31 can be made non-continuous, such as by an etching or sawing step during fabrication. Also, while FIG. 1B shows various passages, such as a recirculation channel 28, a fluid inlet passage 14, and the substrate inlet 12, these components may not all be in a common plane (and are not in a common plane in the implementation illustrated in FIGS. 1C and 1D). In some implementations, two or more of the fluid path body 10, the nozzle layer 11, and the membrane may be formed as a unitary body.

Figure 1C:
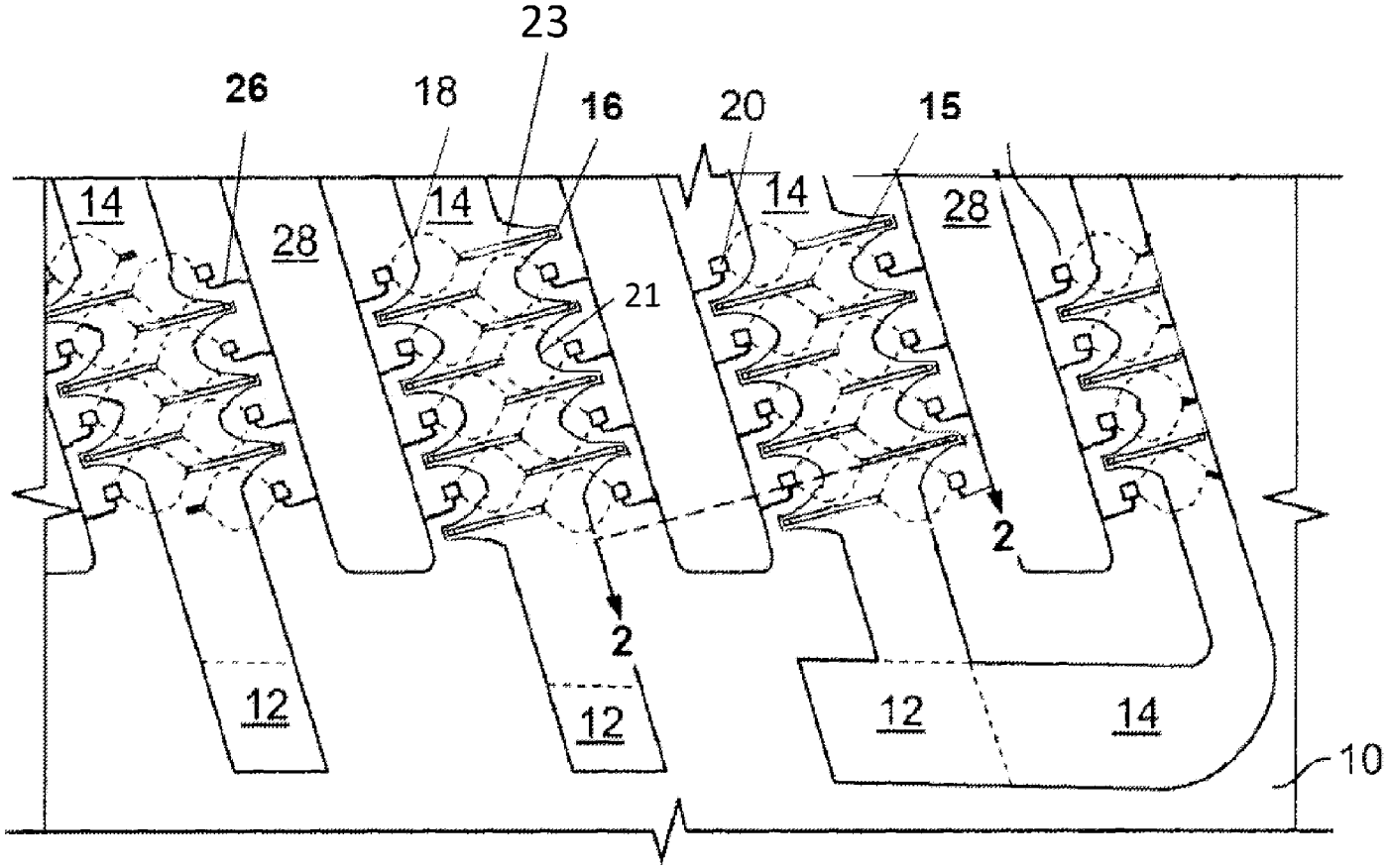
FIG. 1C is a cross-sectional plan view taken along line B-B in FIG. 1B and viewed in the direction of the arrows.
Figure 1D:
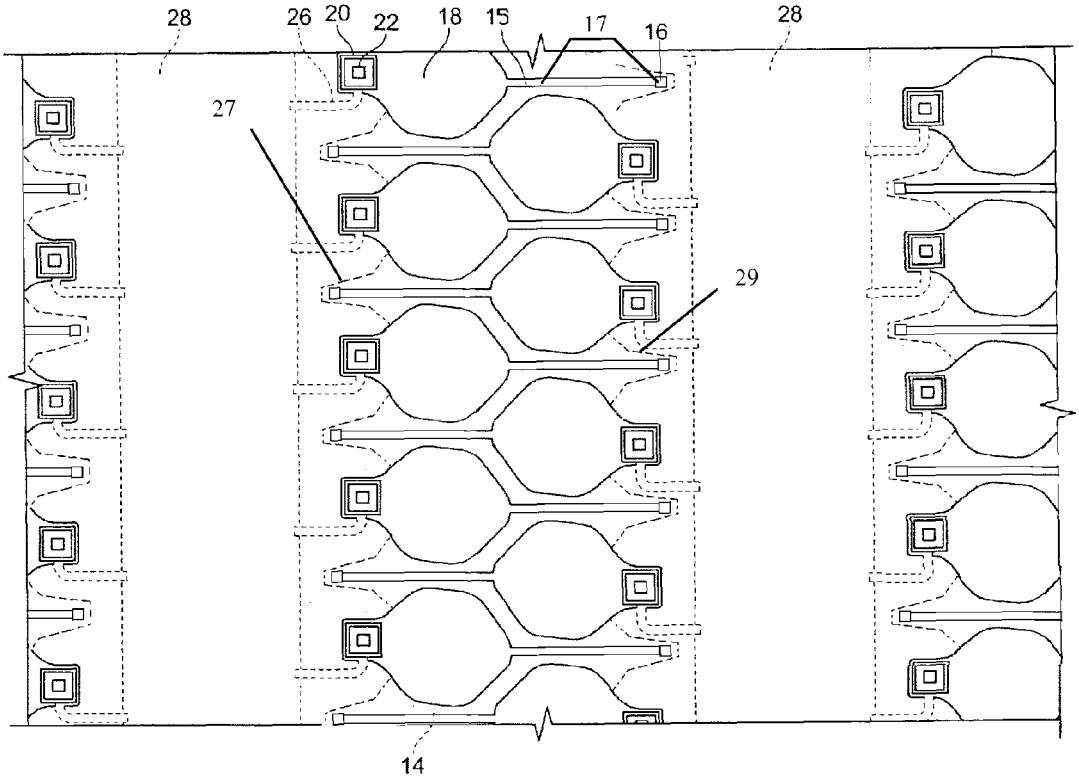
FIG. 1D is a cross-sectional plan view taken along line C-C in FIG. 1B and viewed in the direction of the arrows.

FIG. 1C is an illustrative cross-sectional diagram of a portion of the printhead 100 taken along line B-B in FIG. 1B. FIG. 1D is an illustrative cross-sectional diagram of a portion of the printhead 100 taken along line C-C in FIG. 1B. Referring to FIGS. 1C and 1D, the flow path body 10 includes multiple inlet passages 14 formed therein and extending parallel with one another. Multiple inlet passages 14 are in fluid communication with substrate inlets 12. The flow path body 10 also includes multiple recirculation channels 28 formed therein and in fluid communication with substrate outlets (not shown). The recirculation channels 28 can extend parallel with one another, and can be parallel to the inlet passages 14. The inlet passages 14 and recirculation channels 28 can be arranged in alternating rows. Adjacent columns of nozzles are connected to the same inlet passage 14 or the same recirculation channel 28, but not both. Alternating columns of nozzles can be connected to the same inlet passage 12 14 or the same recirculation channel 28 in an alternating pattern.

As discussed above, the flow path body 10 includes a plurality of flow paths, with each flow path including an ascender 16, a fluid pumping chamber 18, and a descender 20. The ascenders 16 and the fluid pumping chambers 18 are positioned in parallel columns, and the descenders 20 are also positioned in parallel columns. For a given column of nozzles with associated flow paths, each ascender 16 can be fluidically connected to a common fluid inlet passage 14. In addition, each ascender 16 is connected to a corresponding fluid pumping chamber 18 through pumping chamber inlet 15. Pumping chamber inlet 15 can be connected to ascender 16, as described further below. Together, the pumping chamber inlet 15 and ascender 16 can be termed the pumping chamber inlet passage 17 (see FIG. 2). Each pumping chamber 18 is shown fluidically connected to a corresponding descender 20 which leads to an associated nozzle 22. A recirculation passage 26 formed in the flow path body 10 fluidically connects each descender 20 to at least one corresponding recirculation channel 28.

Referring to FIG. 1C, the fluid inlet passage 14 can include a channel having side walls. A plurality of protrusions 21 can extend laterally outward from the side walls (i.e., inwardly into the channel) and can extend the entire height of the fluid inlet passage. That is, each fluid inlet passage 14 can have notches 23 along the side walls to create the protrusions 21. Each protrusion 21 can have approximately the same dimensions, for example a length from a line parallel to the edge of the channel to the tip of the protrusion of about 100-300 μm, for example 170 μm, and a width near the middle of the protrusion of about 150-300 μm, such as 210-250 μm. Alternatively, the dimensions of the protrusions and notches may vary from one protrusion to the next protrusion within a given module, for example, depending on the layout of the pumping chambers, fluid inlet passages, and recirculation channels. The protrusions can have a length that is approximately 20-50%, for example 30%, of the total width of the fluid inlet passage. The protrusions 21 can extend in a regular pattern along the channel, e.g., with a pitch equal to the pitch of the nozzles. Ascenders 16 can extend vertically through the protrusions 21, and pumping chamber inlets 15 can extend horizontally into the protrusions 21. Thus, each pumping chamber inlet can extend through, for example, between 30 and 80%, for example 60% or 70%, of the width of the inlet passage 14. Each protrusion 21 can extend between descenders 20 of neighboring pumping chambers 18.

Referring to FIG. 1D, each pumping chamber 18 can be fluidically connected to a pumping chamber inlet passage 17, including pumping chamber inlet 15 fluidically connected to ascender 16. The pumping chamber inlet 15 can extend horizontally, e.g., perpendicular to the inlet passage 14 and recirculation passage 28, from the pumping chamber 18 to the ascender 16. The pumping chamber inlet 15 can be approximately 200-400 μm in length, for example 310 μm, approximately 5-15 μm in width, for example 10 μm, and approximately 35-75 μm in height, for example 40-50 μm.

Referring still to FIG. 1D, each pumping chamber 18 can be located closer to a first side, for example side 27, of fluid inlet passage 14 than to the second side, for example side 29. For example, each pumping chamber can have an exterior edge that is proximate to a side of the fluid inlet passage 14 and an interior edge that is proximate to the center of the fluid inlet passage 15. The pumping chamber inlet passage 15 can extend from the edge of the pumping chamber that is proximate to the center. The pumping chambers 18 closest to a first side of the fluid inlet passage, for example side 27, can be fluidically connected to pumping chamber inlet passages 17 that are connected to the fluid inlet passage 14 closer to the second side, for example side 29, than the first side of the fluid inlet passage. Likewise, the pumping chambers 18 closest to the second side, for example side 29, can be fluidically connected to pumping chamber inlet passages 17 that are connected to the fluid inlet passage 14 closer to the first side, for example side 27, than the second side. The pumping chamber inlet 15 can extend past an edge of a neighboring pumping chamber 18, for example past the interior edge of the neighboring pumping chamber 18, e.g. can extend such that it is closer to the exterior edge of the neighboring pumping chamber 18 than the interior edge. This increased length of pumping chamber inlet 15 can increase the impedance of fluid flowing through the flow path 474, as discussed below. An ascender 16 can be located closer to the exterior edge of the pumping chamber than the interior edge, e.g. the center of ascender 16 can be aligned horizontally with the exterior edge of neighboring pumping chamber 18. Each ascender 16 can be closer to a descender 20 than any other ascender 16.

Figure 2:
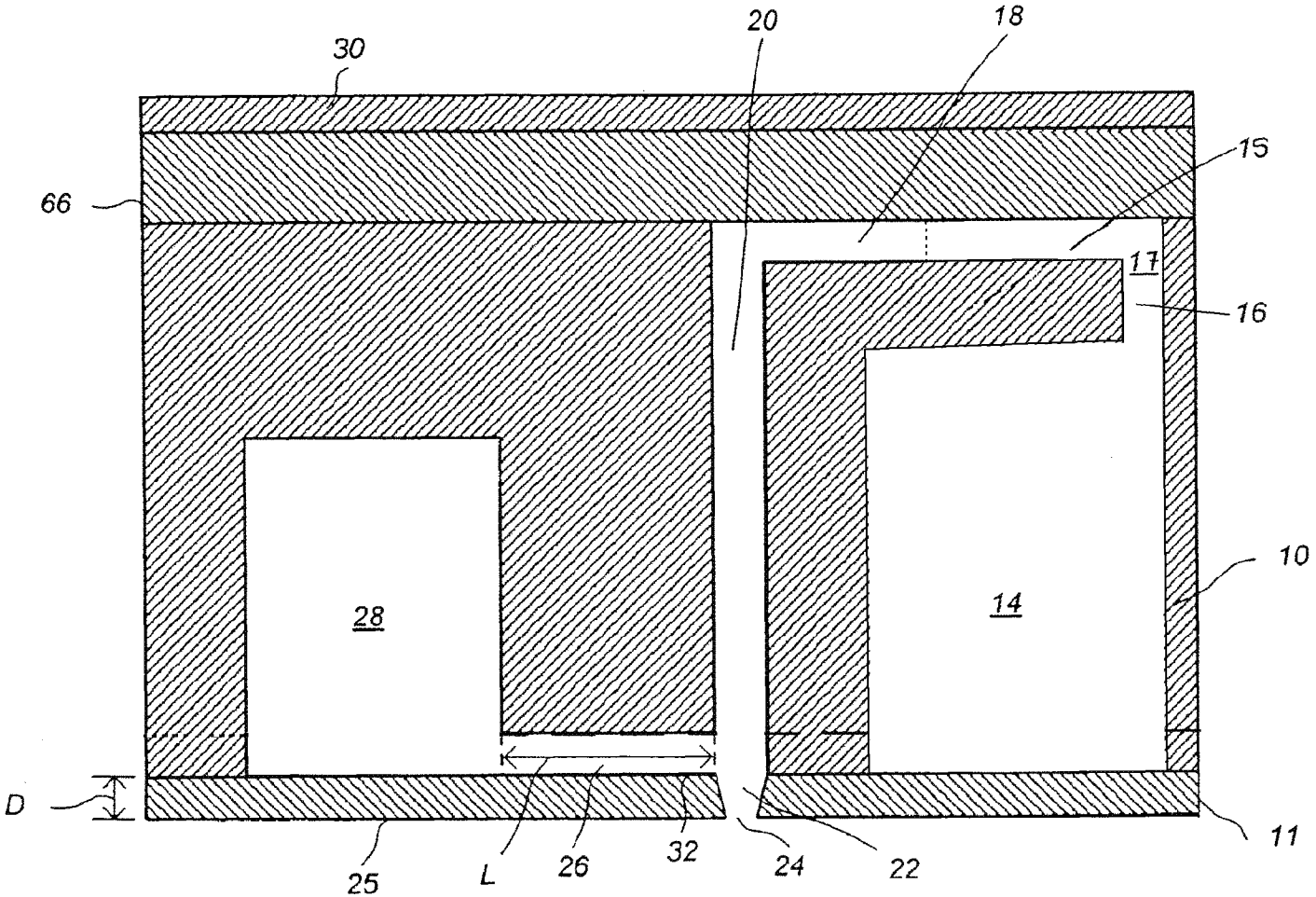
FIG. 2 is a cross-sectional side view taken along line 2-2 in FIG. 1C and viewed in the direction of the arrows.

FIG. 2 is an illustrative cross-sectional diagram taken along line 2-2 in FIG. 1C. The fluid inlet passage 14, ascender 16, fluid pumping chamber 18, descender 20, nozzle 22, and outlet 24 are arranged similar to FIG. 1B. The adhesive layer 67 is not shown for the sake of simplicity. Each ascender 16 can be perpendicular to the pumping chamber inlet 15. The ascender 16 can extend vertically and can fluidically connect the fluid inlet passage 14 to the pumping chamber inlet 15. Although not shown, an ascender inlet can extend, for example horizontally, from the ascender 16 to the fluid inlet passage 14.

Printhead 100 can also include a divider passage 310 (see FIG. 1A) configured to fluidly connect the supply chamber 432 and the return chamber 436. The divider passage 310 can be separated by divider supports (not shown). The divider supports can provide a location for the lower divider 440 to be bonded to the upper interposer 420. The divider supports can also facilitate control of the size of the divider passage 310, particularly the cross-sectional area thereof. Accurate control of the cross-sectional area of the divider passage 310 can be important in controlling the rate of heat transfer between the fluid and the substrate 110 and, in turn the nozzles 22. Without being limited to any particular theory, heat transfer can be a function of the flow rate of fluid through the divider passage 310, which can in turn be a function of the cross-sectional area thereof. Alternatively, the divider supports can be omitted and a single divider passage 310 provided. For example, the upper interposer 420 can be bonded to the lower printhead casing 410 and the lower divider 440 can be free of divider supports, thereby allowing for fluid to flow under an entirety of the lower divider 440 during operation.

In some implementations, a height of the divider passage 310 can be between about 70-150 μm, e.g. 100 μm. The height of the divider passage 310 can be determined based upon the fluid flow requirements through substrate 110, e.g. to maintain fluid in the nozzles 22 and/or to maintain the temperature of the substrate 110. For example, if the impedance of the pumping chamber inlet 15 and recirculation channel 28 are increased, the flow rate through the substrate 110 will be decreased. Therefore, the height of the divider passage 310 can be decreased to allow more fluid to flow through the substrate 110 rather than through the divider passage 310. In implementations where the divider passage 310 is flush with the upper interposer 420, the height of the divider passage 310 can be a distance between the upper interposer 420 and the lower divider 440. In some implementations, the divider passage 310 is separated by the divider supports into six divider passage segments, each segment measuring about 4.6 millimeters by about 5.8 millimeters and having a height of about 160 microns. The divider passage 310 can be flush with the upper interposer 420. Alternatively, the divider passage 310 can be otherwise in thermal communication with the nozzles 22. For example, the divider passage 310 can be positioned closer to the middle of the height of the printhead 100, at some distance from the upper interposer 420.

The divider passage 310 can function as a heat exchanger between the nozzles 22 and the fluid being ejected. Configuration of the dimensions of the divider passage 310 can depend in part upon a minimum, desired, or maximum attainable efficiency, $e_n$, of the divider passage 310 as a heat exchanger. The efficiency, $e_n$, can be equal to a residence time, $T_r$, of the fluid in the divider passage 310 divided by a thermal diffusion time constant, T, of this heat exchanger. The residence time, $T_r$, can be equal to a fluid volume of the divider passages 310 divided by a flow rate of fluid through the divider passages 310. The thermal diffusion time constant, T, can depend on the height D of the divider passages 310 and a diffusivity, α, of the fluid therein, e.g., $T=D^2/\alpha$. The diffusivity, α, of the fluid can depend on a thermal conductivity of the fluid, $K_T$, a density of the fluid, ρ, and a specific heat of the fluid, $C_P$, such as in the relationship: $\alpha=K_T/(\rho \cdot C_P)$. The divider passage 310, and the flow rate of fluid therein, can be configured to achieve an efficiency, $e_n$, sufficiently high to maintain the nozzles 22 at the desired temperature or within the desired temperature range.

Figure 3:
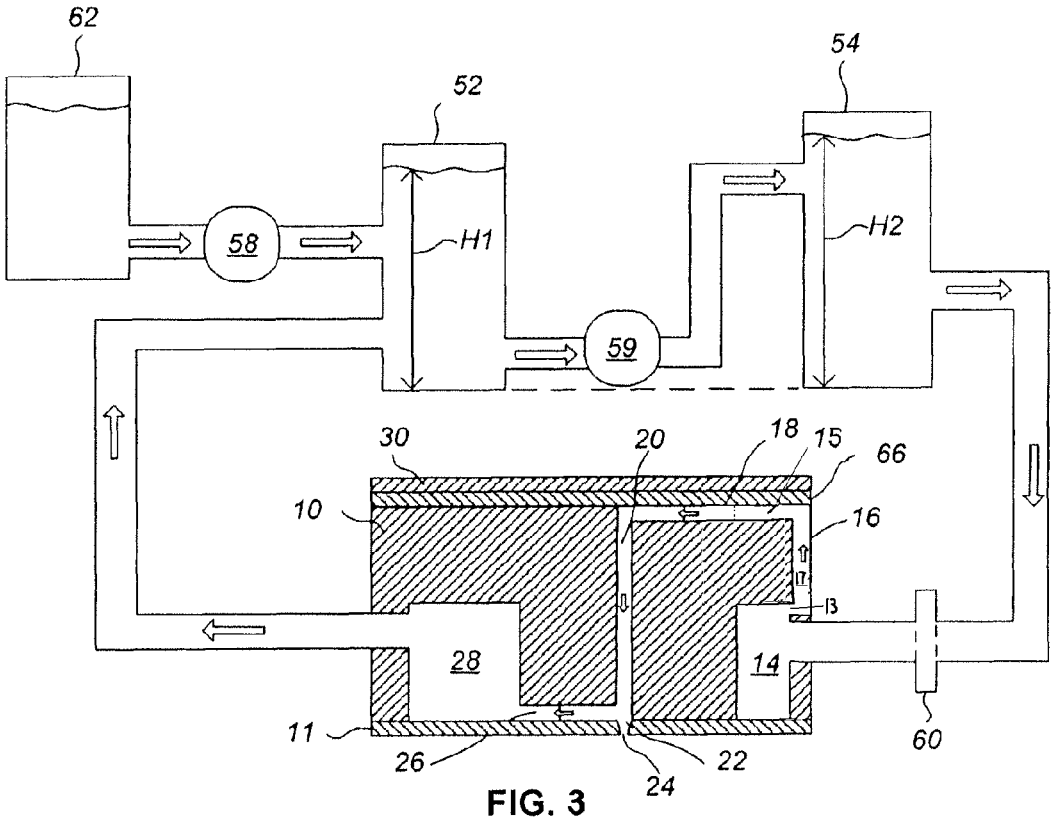
FIG. 3 is a schematic representation of a system for fluid recirculation.

Referring to FIG. 3, a portion of the printhead 100 described above is connected to an implementation of a fluid pumping system. Only a portion of the printhead 100 is shown for the sake of simplicity. The recirculation channel 28 is fluidically connected to a fluid return tank 52. A fluid reservoir 62 is fluidically connected to a reservoir pump 58 that controls a height of fluid in the fluid return tank 52, which can be referred to as the return height H1. The fluid return tank 52 is fluidically connected to a fluid supply tank 54 by a supply pump 59. The supply pump 59 controls a height of fluid in the fluid supply tank 54, which can be referred to as the supply height H2. Alternatively, in some implementations, the supply pump 59 can be configured to maintain a predetermined difference in height between the return height H1 and the supply height H2. The return height H1 and the supply height H2 are measured with respect to a common reference level, for example, as shown by a broken line between the fluid return tank 52 and the fluid supply tank 54 in FIG. 3. The fluid supply tank 54 is fluidically connected to the fluid inlet passage 14. In some implementations, the pressure at the nozzle 22 can be kept slightly below atmospheric, which can prevent or mitigate leakage of fluid or drying of fluid. This can be accomplished by having a fluid level of the fluid return tank 52 and/or the fluid supply tank 54 below the nozzle 22, or by reducing the air pressure over the surface of the fluid return tank 52 and/or the fluid supply tank 54 with a vacuum pump. The fluid connections between the components in the fluid pumping system can include rigid or flexible tubing.

A degasser 60 can be fluidically connected between the fluid supply tank 54 and the fluid inlet passage 14. The degasser 60 can alternatively be connected between the recirculation channel 28 and the fluid return tank 52, between the fluid return tank 52 and the fluid supply tank 54, or in some other suitable location. The degasser 60 can remove air bubbles and dissolved air from the fluid, e.g., the degasser 60 can deaerate the fluid. Fluid exiting the degasser 60 may be referred to as deaerated fluid. The degasser 60 can be of a vacuum type, such as a SuperPhobic® Membrane Contactor available from Membrana of Charlotte, N.C. Optionally, the system can include a filter for removing contaminants from the fluid (not shown). The system can also include a heater (not shown) or other temperature control device for maintaining the fluid at a desired temperature. The filter and heater can be fluidically connected between the fluid supply tank 54 and the fluid inlet passage 14. Alternatively, the filter and heater can be fluidically connected between the recirculation channel 28 and the fluid return tank 52, between the fluid return tank 52 and the fluid supply tank 54, or in some other suitable location. Also optional, a make-up section (not shown) can be provided to monitor, control, and/or adjust properties of or a composition of the fluid. Such a make-up section can be desirable, for example, where evaporation of fluid (e.g., during long periods of non-use, limited use, or intermittent use) may result in changes in a viscosity of the fluid. The make-up section can, for example, monitor the viscosity of the fluid, and the make-up section can add a solvent to the fluid to achieve a desired viscosity. The make-up section can be fluidically connected between the fluid supply tank 54 and the printhead 100, between the fluid return tank 52 and the fluid supply tank 54, within the fluid supply tank 54, or in some other suitable location.

In operation, the fluid reservoir 62 supplies the reservoir pump 58 with fluid. The reservoir pump 58 controls the return height H1 in the fluid return tank 52. The supply pump 59 controls the supply height H2 in the fluid supply tank 54. The difference in height between the supply height H2 and the return height H1 causes a flow of fluid through the degasser 60, the printhead 100, and any other components that are fluidically connected between the fluid supply tank 54 and the fluid return tank 52, and this flow of fluid can be caused without directly pumping fluid into or out of the printhead 100. That is, there is no pump between the fluid supply tank 54 and the printhead 100 or between the printhead 100 and the fluid return tank 52. Fluid from the fluid supply tank 54 flows through the degasser 60, through the substrate inlet 12 (FIG. 1B), and into the fluid inlet passage 14. From the fluid inlet passage 14, fluid flows through the ascender 16, through the pumping chamber inlet 15, and into the fluid pumping chamber 18. Fluid then flows through the descender 20 and either to the outlet 24 or to the recirculation passage 26. A majority of the fluid flows from the region near the nozzle 22 through the recirculation passage 26 and into the recirculation channel 28. From the recirculation channel 28, fluid is able to flow back to the fluid return tank 52. Although not shown in FIG. 3, fluid can also recirculate through divider passage 310 (see FIG. 1A) back to the fluid return tank 52.

The flow of fluid is not, in some implementations, sufficient to cause fluid to be ejected from the outlet 24. For example, referring to FIG. 1B, an actuator, such as a piezoelectric transducer or a resistive heater, is provided adjacent to the fluid pumping chamber 18 or the nozzle 24 and can effect droplet ejection. The actuator 30 can include a piezoelectric layer 31, such as a layer of lead zirconium titanate (PZT). Electrical voltage applied to the piezoelectric layer 31 can cause the layer to change in shape. If a membrane 66 (see FIG. 1B) between the actuator 30 and the fluid pumping chamber 18 is able to move due to the piezoelectric layer 31 changing in shape, then electrical voltage applied across the actuator 30 can cause a change in volume of the fluid pumping chamber 18. This change in volume can produce a pressure pulse, which is herein referred to as a firing pulse. A firing pulse can cause a pressure wave to propagate through the descender 20 to the nozzle 22 and outlet 24. A firing pulse can thereby cause ejection of fluid from the outlet 24.

Figure 4A:
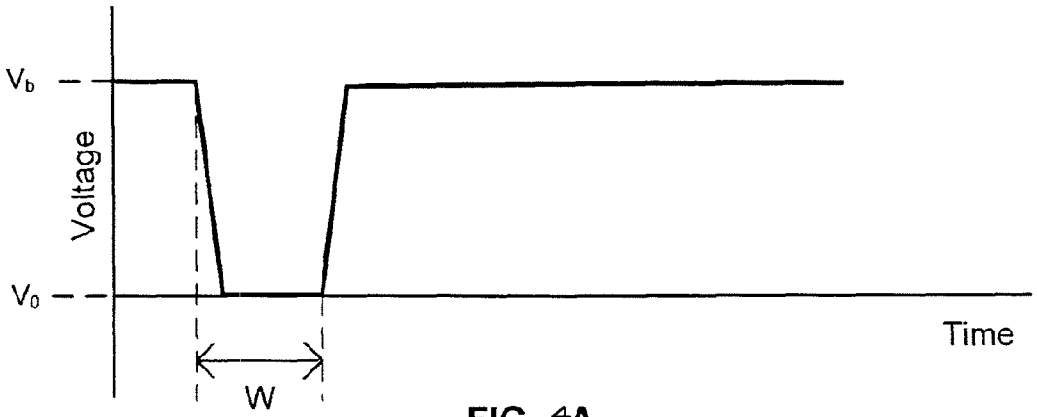
FIG. 4A is a graph representing a firing pulse.
Figure 4B:
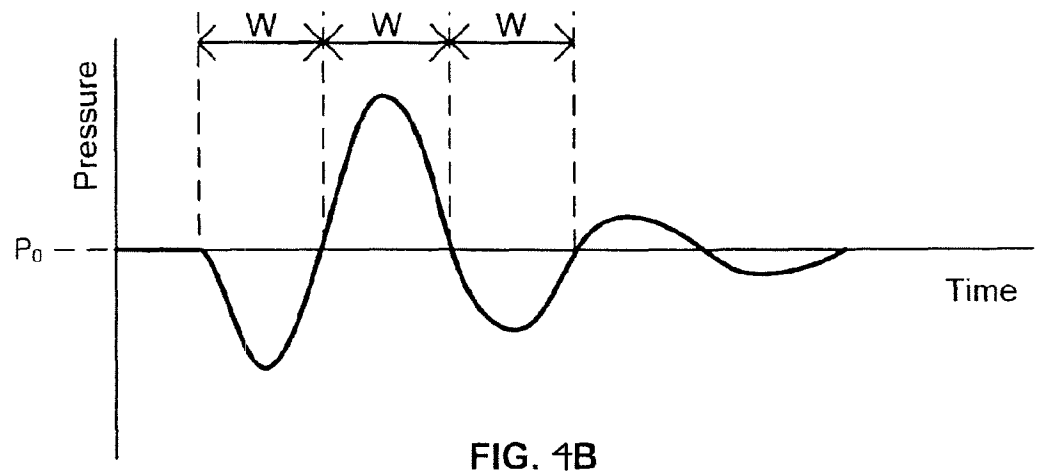
FIG. 4B is a graph representing a pressure response to the firing pulse shown in FIG. 4A.

FIG. 4A shows a graph of voltage applied across an actuator 30 over time. When the actuator 30 is not firing, a bias voltage $V_b$ exists across the actuator 30. FIG. 4B shows a graph of pressure in the fluid pumping chamber 18 over time. Referring to FIG. 4A, the firing pulse has a firing pulse width, W. This firing pulse width W is a length of time approximately defined by a drop in voltage to a lower voltage $V_0$ and a dwell at the lower voltage $V_0$. Circuitry (not shown) in electrical communication with the actuator 30 can include drivers configured to control the shape of the firing pulse, including the firing pulse frequency and the size of the firing pulse width W. The circuitry can also control timing of the firing pulse. The circuitry can be automatic or can be controlled manually, such as by a computer with computer software configured to control fluid droplet ejection, or by some other input. In alternative embodiments, the firing pulse may not include a bias voltage $V_b$. In some embodiments, the firing pulse may include an increase in voltage, both an increase in voltage and a decrease in voltage, or some other combination of changes in voltage.

Referring to FIG. 4B, the firing pulse causes a fluctuation in pressure in the fluid pumping chamber 18 with a frequency corresponding to the firing pulse frequency. The pressure in the fluid pumping chamber 18 first drops below normal pressure $P_0$ for a period of time corresponding to the firing pulse width W. The pressure in the fluid pumping chamber 18 then oscillates above and below normal pressure $P_0$ with diminishing amplitude until the pressure in the fluid pumping chamber returns to normal pressure $P_0$ or until the actuator 30 again applies pressure. The amount of time that the pressure is above or below normal pressure $P_0$ during each oscillation of the pressure in the fluid pumping chamber 18 corresponds with the firing pulse width W. The firing pulse width W can depend on a particular fluid path design (e.g., dimensions of the fluid pressure path, such as size of the pumping chamber 18, and whether the fluid path includes an ascender 16 or descender 20) and/or the drop volume being ejected. For example, as a pumping chamber decreases in size, the resonant frequency of the pumping chamber increases, and therefore the width of the firing pulse can decrease. For a pumping chamber ejecting a drop volume of about 2 picoliters, the pulse width, W, can be, for example, between about 2 microseconds and about 3 microseconds, and for a pumping chamber 18 that effects ejection of a drop volume of about 100 picoliters, the pulse width W can be between about 10 and about 15 microseconds.

In some implementations, when actuators are activated, some of the energy from the pressure wave in the pumping chamber 18 can propagate through ascender 16 and into the fluid inlet passage 14. The pressure wave in the pumping chamber 18 can also propagate down the descender 20 through the recirculation passage 26 and into the recirculation channel 28. Pressure waves can thus develop in the fluid inlet passage 14 and recirculation channel 28, which can adversely effect the ejection of fluid, as pressure fluctuations in the fluid inlet passage 14 and recirculation channel 28 can cause velocity variations in the jets, resulting in drop placement errors. Such fluctuations caused by individual jets can be referred to as "fluidic crosstalk."

Referring to FIG. 1C, by lengthening the pumping chamber inlet 15 such that it extends closer to the side of the fluid inlet passage 14 than the middle, and by decreasing the width of the pumping chamber inlet 15, the impedance of the pumping chamber inlet 15 can increase, thereby decreasing the energy that propagates into the fluid inlet passage 14. Likewise, by spacing neighboring ascenders 16 further apart from each other, e.g. closer to a descender 20 than another ascender 16, interaction of pressure waves from each flow path can be mitigated. Furthermore, without being limited to any particular theory, if the ascenders 16 extend through protrusions 21 in the fluid inlet passage 14, energy from the pressure waves can dissipate into the wall of the fluid inlet passage rather than into the fluid inlet passage 14 and/or the protrusions can act like barriers to prevent pressure waves from the ascenders from interacting with neighboring ascenders. Impedance can also be increased by decreasing the width of the recirculation passage 26. Finally, since the impedance through the flow path body can be increased, the flow rate through the flow path body is decreased. Thus, by increasing the pressure differential between the fluid supply path to the printhead 100 and the fluid return path, e.g. by decreasing the width of divider passage 310, the flow rate through the flow path body can be maintained at the same flow rate as before the impedance was increased.

It should be understood that terms of positioning and orientation (e.g., top, vertical) have been used to describe the relative positioning and orientation of components within the ink droplet ejection apparatus, but the apparatus itself can be held in a vertical or horizontal orientation or some other orientation.

Although the invention has been described herein with reference to specific embodiments, other features, objects, and advantages of the invention will be apparent from the description and the drawings. All such variations are included within the intended scope of the invention as defined by the following claims.

What is claimed is:

1. A fluid droplet ejection apparatus comprising:

a substrate including a fluid inlet passage, a plurality of nozzles, and a plurality of flow paths each fluidically connecting the fluid inlet passage to an associated nozzle of the plurality of nozzles, each flow path of the plurality of flow paths including a pumping chamber fluidically connected to the associated nozzle and a pumping chamber inlet passage fluidically connecting the fluid inlet passage and the pumping chamber, the pumping chamber inlet passage including a vertical passage located proximate to an outside edge of the fluid inlet passage and a pumping chamber inlet extending horizontally in a first direction from the vertical passage to a side wall of the pumping chamber, wherein the pumping chamber inlet is longer than the pumping chamber along the first direction.

2. The fluid droplet ejection apparatus of claim 1, wherein the vertical passage comprises an ascender.

3. The fluid droplet ejection apparatus of claim 1, wherein the pumping chamber and the pumping chamber inlet have the same height.

4. The fluid droplet ejection apparatus of claim 1, wherein the pumping chamber inlet extends linearly from the vertical passage to the pumping chamber.

5. The fluid droplet ejection apparatus of claim 1, wherein the pumping chamber inlet is narrower than the pumping chamber along a horizontal second direction perpendicular to the first direction.

6. A fluid droplet ejection apparatus comprising:

a substrate including a fluid inlet passage, a plurality of nozzles, and a plurality of flow paths each fluidically connecting the fluid inlet passage to an associated nozzle of the plurality of nozzles, each flow path of the plurality of flow paths including a descender fluidically connected to the associate nozzle, a pumping chamber fluidically connected to the descender, and a pumping chamber inlet passage fluidically connecting the fluid inlet passage and the pumping chamber, the pumping chamber inlet passage including a vertical passage located proximate to an outside edge of the fluid inlet passage with a vertical side wall of the vertical passage flush with the outside edge of the fluid inlet passage, wherein the vertical passage and the descender are located on laterally opposite sides of the fluid inlet passage.

7. The fluid droplet ejection apparatus of claim 6, wherein the vertical passage comprises an ascender.

8. The fluid droplet ejection apparatus of claim 6, wherein the pumping chamber inlet passage includes a pumping chamber inlet extending horizontally and linearly from the vertical passage to the pumping chamber.

9. The fluid droplet ejection apparatus of claim 8, wherein the pumping chamber inlet extends perpendicular to the inlet passage.

10. A fluid droplet ejection apparatus comprising:

a substrate including a fluid inlet passage having a first side and a second side, a first plurality of nozzles, a second plurality of nozzles, a first plurality of flow paths each fluidically connecting the fluid inlet passage to an associated nozzle of first plurality of nozzles, and a second plurality of flow paths each fluidically connecting the fluid inlet passage to an associated nozzle of second plurality of nozzles, wherein each flow path of the first and second pluralities of flow paths includes a pumping chamber connected to the associated nozzle and a pumping chamber inlet passage fluidically connecting the fluid inlet passage and the pumping chamber, wherein the pumping chamber of each of the first plurality of flow paths is located closer to the first side of the fluid inlet passage than the second side and the pumping chamber of each of the second plurality of flow paths is located closer to the second side of the fluid inlet passage than the first side, and wherein the pumping chamber inlet passage of each of the first plurality of flow paths is connected to the fluid inlet passage closer to the second side of the fluid passage than the first side and the pumping chamber inlet passage of each of the second plurality of flow paths is connected to the fluid inlet passage closer to the first side of the fluid passage than the second side;

wherein each pumping chamber inlet passage includes a horizontally extending pumping chamber inlet fluidically connected between the pumping chamber and an ascender, the ascender being fluidically connected to the fluid inlet passage; and wherein each pumping chamber has an edge on a side of the pumping chamber opposite the pumping chamber inlet, and the pumping chamber inlet of each of the first plurality of flow paths extends past the edge of the pumping chamber of each of the second plurality of flow paths, and wherein the pumping chamber inlet of each of the second plurality of flow paths extends past the edge of the pumping chamber of each of the first plurality of flow paths.

11. The fluid droplet ejection apparatus of claim 10, wherein the pumping chamber of each of the first plurality of flow paths comprises an exterior edge proximate to the first side of the fluid inlet passage and an interior edge near a center of the fluid inlet passage, and wherein the pumping chamber of each of the second plurality of flow paths comprises an exterior edge proximate to the second side of the fluid inlet passage and an interior edge near the a center of the fluid inlet passage.

12. The fluid droplet ejection apparatus of claim 11, wherein the ascender of each of the second plurality of flow paths is closer to the exterior edge of the pumping chamber in each of the first plurality of flow paths than the interior edge of the pumping chamber in each of the first plurality of flow paths, and wherein the ascender of each of the first plurality of flow paths is closer to the exterior edge of the pumping chamber in each of the second plurality of flow paths than the interior edge of the pumping chamber in each of the second plurality of flow paths.

13. The fluid droplet ejection apparatus of claim 11, wherein the ascender of each of the second plurality of flow paths is horizontally aligned with the exterior edge of the pumping chamber in each of the first plurality of flow paths, and wherein the ascender of each of the first plurality of flow paths is horizontally aligned with the exterior edge of the pumping chamber in each of the second plurality of flow paths.

14. The fluid droplet ejection apparatus of claim 10, wherein each pumping chamber is connected to the associated nozzle through a descender fluidically connected to the pumping chamber and the associated nozzle.

15. The fluid droplet ejection apparatus of claim 14, wherein the ascender of each of the first plurality of flow paths is closer to the descender of each of the second plurality of flow paths than to another ascender, and wherein the ascender of each of the second plurality of flow paths is closer to the descender of each of the first plurality of flow paths than to another ascender.

16. The fluid droplet ejection apparatus of claim 10, wherein the ascender extends vertically from the fluid inlet passage to the pumping chamber inlet.

17. The fluid droplet ejection apparatus of claim 16, wherein the pumping chamber inlet is perpendicular to the ascender.

18. The fluid droplet ejection apparatus of claim 10, wherein the pumping chamber inlet runs horizontally from the pumping chamber to the ascender.

19. The fluid droplet ejection apparatus of claim 10, wherein the pumping chamber inlets of the respective flow paths run parallel to each other.

20. The fluid droplet ejection apparatus of claim 10, further comprising an actuator in pressure communication with the substrate.

21. The fluid droplet ejection apparatus of claim 10, wherein there are a plurality of fluid inlet passages, and wherein the fluid inlet passages run parallel to each other.

22. The fluid droplet ejection apparatus of claim 10, wherein the nozzles are arranged in a line.

23. The fluid droplet ejection apparatus of claim 10, wherein the pumping chambers of the first plurality of flow paths are arranged in a first line, the pumping chambers of the second plurality of flow path are arranged in a second line, and the first and second line are parallel.

24. A fluid droplet ejection apparatus comprising:

a substrate including:

a plurality of flow paths, each flow path including a fluid pumping chamber and an ascender fluidically connected to the fluid pumping chamber; and a fluid inlet passage fluidically connected to the plurality of flow paths, the fluid inlet passage comprising a channel having side walls, wherein a plurality of protrusions extend from the sidewalls, and wherein the plurality of protrusions extend the entire height of the fluid inlet passage.

25. The fluid droplet ejection apparatus of claim 24, wherein the ascenders in the plurality of flow paths extend vertically through the protrusions.

26. The fluid droplet ejection apparatus of claim 24, wherein the plurality of protrusions extend laterally outward.

27. The fluid droplet ejection apparatus of claim 24, wherein each of the plurality of protrusions extends in between a pair of descenders, wherein each of the descenders is part of a corresponding flow path in the plurality of flow paths, and wherein each of the descenders is in fluid connection with the corresponding pumping chamber.

28. The fluid droplet ejection apparatus of claim 24, wherein each of the plurality of protrusions has approximately the same length.

29. The fluid droplet ejection apparatus of claim 24, further comprising a pumping chamber inlet fluidically connected to the pumping chamber and the ascender, and wherein the pumping chamber inlets in the plurality of flow paths extend horizontally into the protrusions.

* * * * *